US007707752B2

(12) United States Patent
Stoetzer

(10) Patent No.: US 7,707,752 B2
(45) Date of Patent: May 4, 2010

(54) TRENCH WALL IN THE GROUND AND METHOD FOR THE PRODUCTION THEREOF

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 231 days.

(21) Appl. No.: 11/193,412

(22) Filed: Aug. 1, 2005

(65) Prior Publication Data

US 2006/0046423 A1 Mar. 2, 2006

(30) Foreign Application Priority Data

Sep. 1, 2004 (EP) ..... 04020789

(51) Int. Cl.
*E02F 1/00* (2006.01)

(52) U.S. Cl. ..... 37/195

(58) Field of Classification Search ..... 37/189, 37/462, 352, 364, 365, 195; 299/106
See application file for complete search history.

(56) References Cited

U.S. PATENT DOCUMENTS 428,951 A * 5/1890 Richards ..... 299/72
1,388,650 A * 8/1921 Josephs, Jr. ..... 37/304
2,207,854 A * 7/1940 Foreman et al. ..... 37/104
3,538,629 A * 11/1970 Hemphill ..... 37/195
4,662,684 A * 5/1987 Marten ..... 299/1.5
4,694,915 A 9/1987 Bauer et al.
4,696,607 A * 9/1987 Ressi di Cervia ..... 405/267
5,601,383 A * 2/1997 Zanin ..... 405/154.1
6,154,988 A * 12/2000 Bykov et al. ..... 37/352
7,152,346 B2 * 12/2006 Arzberger ..... 37/189
7,172,033 B2 * 2/2007 Woodcock et al. ..... 172/253
7,178,273 B2 * 2/2007 Arzberger ..... 37/189

FOREIGN PATENT DOCUMENTS

DE 16 34 487 12/1966
DE 195 30 827 8/1995

* cited by examiner

*Primary Examiner*—Gary S Hartmann
(74) *Attorney, Agent, or Firm*—Jacobson Holman PLLC

(57) ABSTRACT

The invention relates to a method for producing a trench wall in the ground and which is penetrated by an obstacle, lateral trench wall recesses being sunk on either side of the obstacle and below the obstacle is produced a lower trench wall recess by laterally pivoting in a soil-removing trench wall apparatus from at least one of the two trench wall recesses. The invention also relates to a trench wall.

10 Claims, 3 Drawing Sheets

TRENCH WALL IN THE GROUND AND METHOD FOR THE PRODUCTION THEREOF

BACKGROUND OF THE INVENTION

1. Field of the Invention

The invention relates to a method for producing a trench wall in the ground. The invention also relates to a trench wall in the ground.

2. Related Art

Trench walls are more particularly seals made perpendicularly in the ground and which serve to prevent water in the ground penetrating a zone surrounded by trench walls. They are produced in that a trench is made in the ground and into said trench is introduced a suspension which hardens to the trench wall.

If there are obstacles in the ground, such as e.g. supply lines, pipes, mast bases, etc., according to the prior art they have to be removed and relocated prior to trench production. This involves considerable economic losses.

SUMMARY OF THE INVENTION

The object of the invention is to provide a method for producing a trench wall and to a trench wall usable in particularly economic manner also when there are obstacles in the ground.

According to the invention this object is achieved by a method for producing a trench wall through which projects an obstacle, in which lateral trench wall recesses are sunk on either side of the obstacle and below the obstacle is produced a lower trench wall recess by laterally moving in a soil-removing trench wall apparatus from at least one of the two lateral trench wall recesses; and a trench wall in the ground, particularly produced according to above method, wherein the trench wall is made round an obstacle which penetrates said trench wall.

The method according to the invention is used for producing a trench wall in the ground through which passes an obstacle. It is characterized in that on either side of the obstacle are sunk lateral trench wall recesses and below the obstacle is produced a lower trench wall recess by laterally moving in a soil-removing trench wall apparatus from at least one of the lateral trench wall recesses.

A fundamental idea of the invention is to no longer dismantle in costly manner an obstacle in the vicinity of a trench wall to be produced and then reinstall it after the trench wall has been produced, but instead to integrate the obstacle into the trench wall during production. This saves costs and time compared with the conventional methods.

According to the invention the trench wall is produced in that soil material is released from around the obstacle located in the ground. For this purpose at least one trench wall recess is made on either side of the obstacle. In addition, soil material is also released below the obstacle and a lower trench wall recess is produced there, which in particular links the lateral trench wall recesses. By introducing hardenable suspension into the two lateral trench wall recesses and into the lower trench recess, according to the invention a trench wall embracing the obstacle can be produced.

According to the invention the soil material in the lower trench wall recess is particularly loosened in that a soil-removing trench wall apparatus is moved laterally, starting from at least one of the two lateral trench wall recesses, and as a result is moved into the soil area below the obstacle.

It is fundamentally possible to remove the soil area below the obstacle starting from a single lateral trench wall recess. In this case the trench wall apparatus can be introduced into one of the two lateral trench wall recesses and is laterally moved below the obstacle, accompanied by soil removal, until it has reached the second lateral trench wall recess or an area in which the second lateral trench wall recess is subsequently sunk. However, it is preferable for the trench wall apparatus to be pivoted in from both lateral trench wall recesses below the obstacle. In this case the lower trench wall recess is produced, starting from both lateral trench wall recesses. Starting from one of the two lateral trench wall recesses, initially soil material is loosened in a first partial area below the obstacle. In particular at a later time and starting from the other lateral trench wall recess, soil material is loosened in a second partial area below the obstacle and to complete the trench is advanced into the first partial area. In this embodiment the lateral pivoting in paths of the trench wall apparatus are particularly small and said apparatus can have a correspondingly simple and compact construction. Fundamentally it is also possible to pivot in simultaneously with two trench wall apparatuses from both lateral trench wall recesses.

According to the invention it is particularly advantageous for the lower trench wall recess and at least one, particularly both, lateral trench wall recesses to be produced with the same trench wall apparatus. Advantageously soil material is loosened below the obstacle for producing the lower trench wall recess immediately following the sinking of a lateral trench wall recess, i.e. after producing the lateral trench wall recess the trench wall apparatus remains in the ground for lateral pivoting in. However, it is also possible to use different trench wall apparatuses for producing the lateral and the lower trench wall recesses.

The trench wall apparatus can e.g. be constituted by a trench wall grab, which e.g. has control flaps for pivoting in below the obstacle. However preferably, the trench wall apparatus is a trench wall cutter, which is preferably located on a rigid linear guide device. Such a trench wall cutter appropriately has at least one and preferably two bottom-side cutting wheels, which can in particular be constructed as cutting wheel pairs with two coaxially arranged individual cutting wheels. The term rigid linear guide device is understood to mean a guide device allowing an axial advance and retraction of the trench wall apparatus, but which is constructed in rigid manner with respect to lateral displacements. Such a rigid linear guide device is e.g. provided with a linkage of fixed length, which is guided for linear guidance purposes in at least one guide sleeve. The rigid linear guide device can also have a telescopable linkage on the bottom of which is provided a trench wall apparatus.

For a particularly simple lateral pivoting in the area below the obstacle, the trench wall cutter, particularly for forming the lower trench wall recess, is displaced with the linear guide device along the trench wall to be produced by means of a displacement mechanism. According to this embodiment the linear guide device is displaced laterally for pivoting in the trench wall apparatus, the lateral movement being transferred by the rigid linear guide device to the trench wall cutter. Thus, in this case the pivoting in of the trench wall apparatus is brought about by a displacement of the linear guide device and the corresponding displacement device can preferably be located outside the trench wall recess and/or can have a construction truck. In particular, no pivoting in devices have to be provided on the trench wall apparatus, so that the latter can have a particularly simple construction.

In order to be able to produce tight trench walls in the ground even when there are large obstacles, according to the invention for forming the lower trench wall recess the trench wall cutter can be introduced under the obstacle at an oblique angle. An oblique angle can in particular exist with respect to the sinking direction of at least one of the two lateral trench wall recesses and/or to the vertical. Introduction under an oblique angle also allows the incorporation of obstacles with an angular shape into the trench wall.

For introduction under an oblique angle it is in particular possible to tilt the linear guide device and for this purpose e.g. on the construction truck where the linear guide device is located a pivoting device can be provided. Alternatively or additionally the trench wall cutter can also be simultaneously axially and laterally moved, i.e. can be pivoted in laterally accompanied by simultaneous lowering and/or raising.

In order to substantially completely bind the obstacle into the trench wall, it is preferred according to the invention that an upper trench wall recess is produced above the obstacle. Appropriately use is made of the same trench wall apparatus as is used for producing the other trench wall recesses. An upper trench wall recess can in particular be provided if the obstacle does not extend to the ground surface or projects from the ground.

To avoid damaging the obstacle, at least one of the trench wall recesses can be produced at a distance from the obstacle. The resulting intermediate area between the trench wall recess and the obstacle can be cleared and/or fixed in a further working step.

A particularly economic method arises if the soil material released during trench wall recess production is mixed with a binder within the trench wall recesses for forming a settable suspension. According to this preferred embodiment the hardening suspension is not produced outside the trench, but so-to-speak in situ directly in the trench. For this purpose the binder is appropriately introduced into the ground close to the trench wall apparatus and is mixed there with the soil material released by the trench wall apparatus, accompanied by the formation of the hardening suspension.

It is also very advantageous if firstly the two lateral trench wall recesses and then the upper trench wall recess are produced. This largely prevents any deviation of the trench wall cutter when sinking the trench wall recesses.

An inventive trench wall can in particular be produced with an inventive method, so that the advantages explained in conjunction therewith can be achieved. A trench wall according to the invention is characterized in that it is produced around an obstacle which penetrates said trench wall.

In the case of a trench wall according to the invention during trench wall production the obstacle can remain in the ground and does not have to be removed prior to trench wall production and then reintroduced thereafter.

BRIEF DESCRIPTION OF THE DRAWINGS

Preferred embodiments of the invention are described in greater detail hereinafter relative to FIGS. 1, 2, and 3 of the drawings, wherein.

DETAILED DESCRIPTION OF THE PREFERRED EMBODIMENTS

Figure 1:
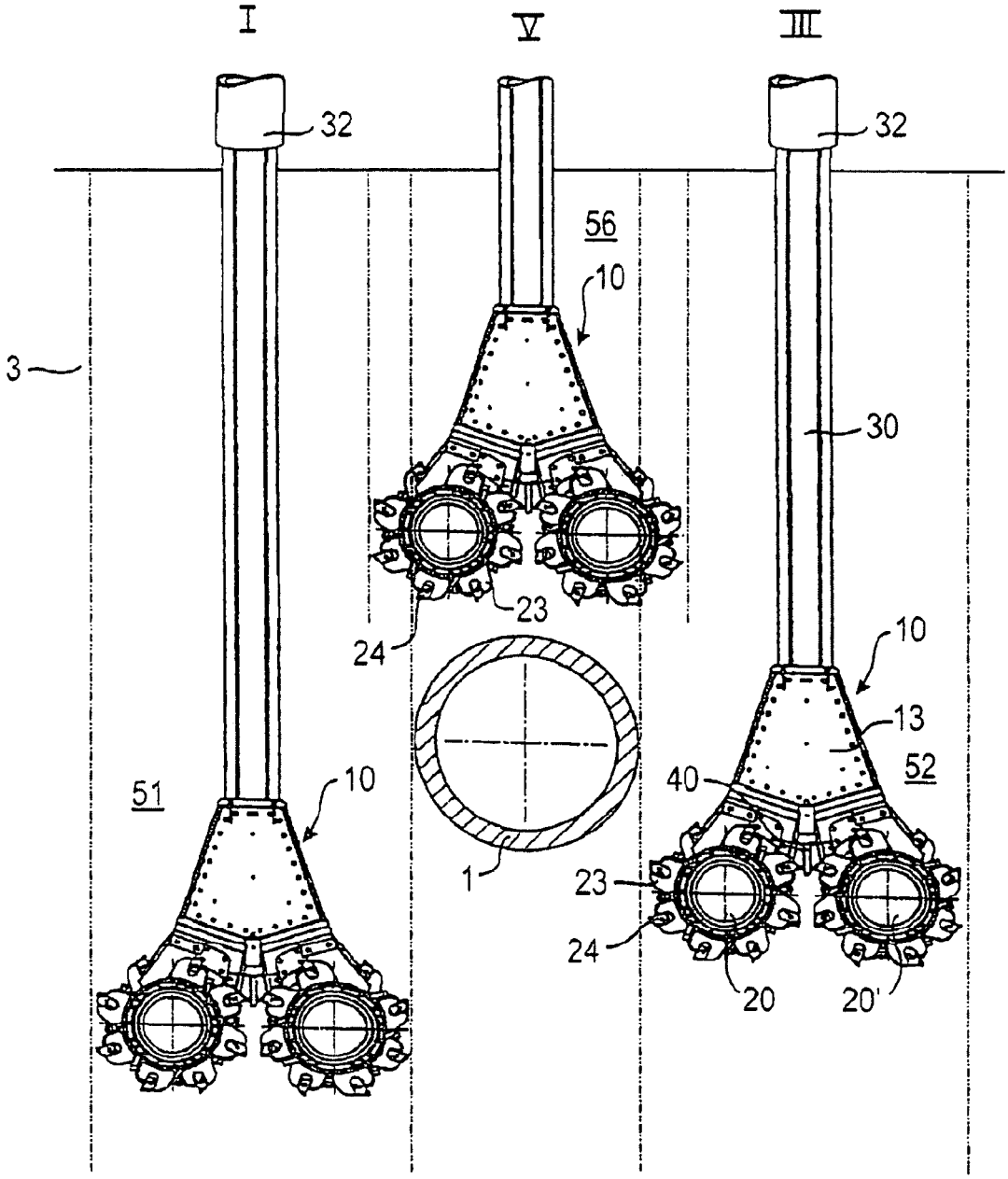
FIGS. 1 and 2 are side views of a trench wall cutter in different stages of the performance of the method according to the invention.
Figure 2:
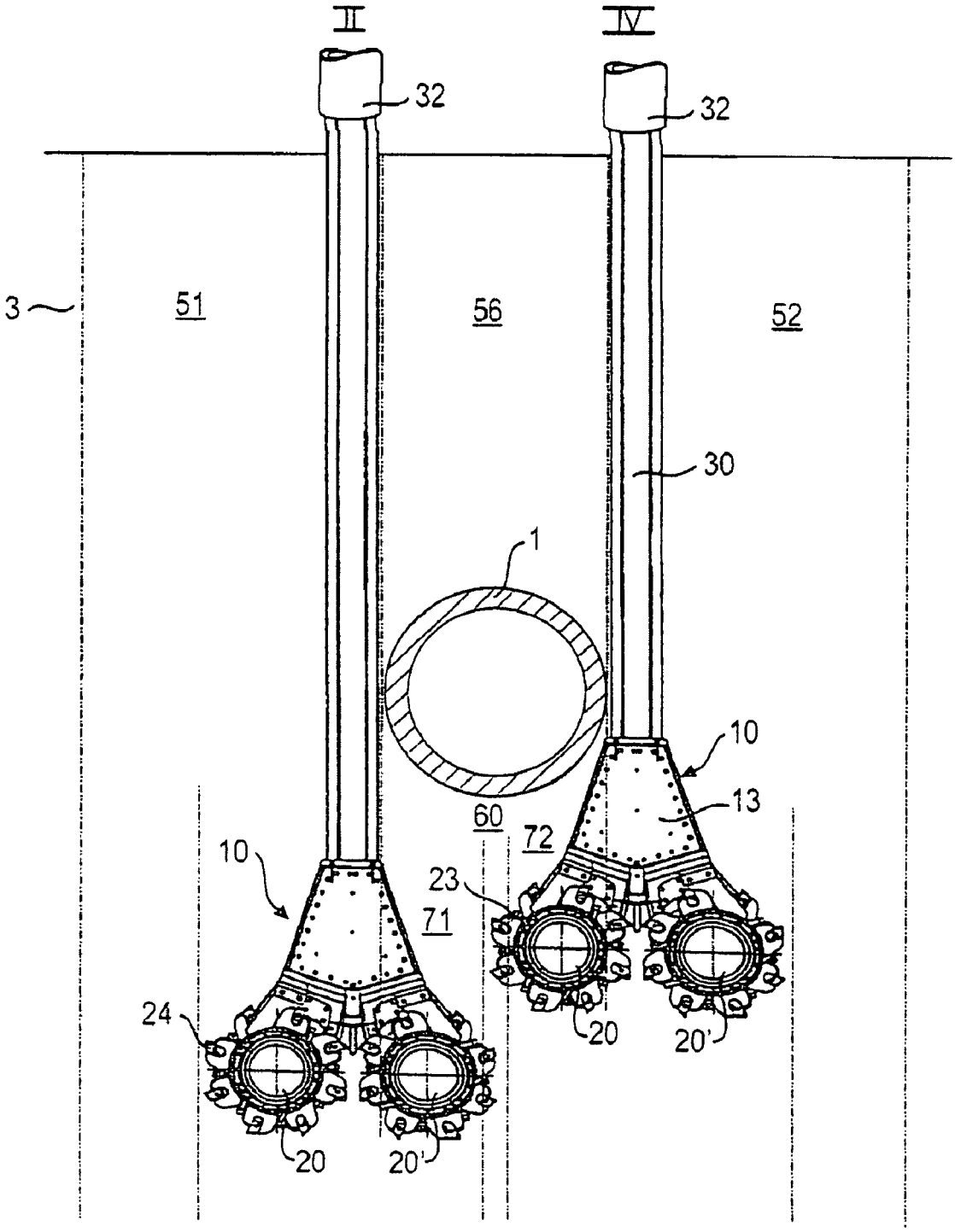
Figure 3:
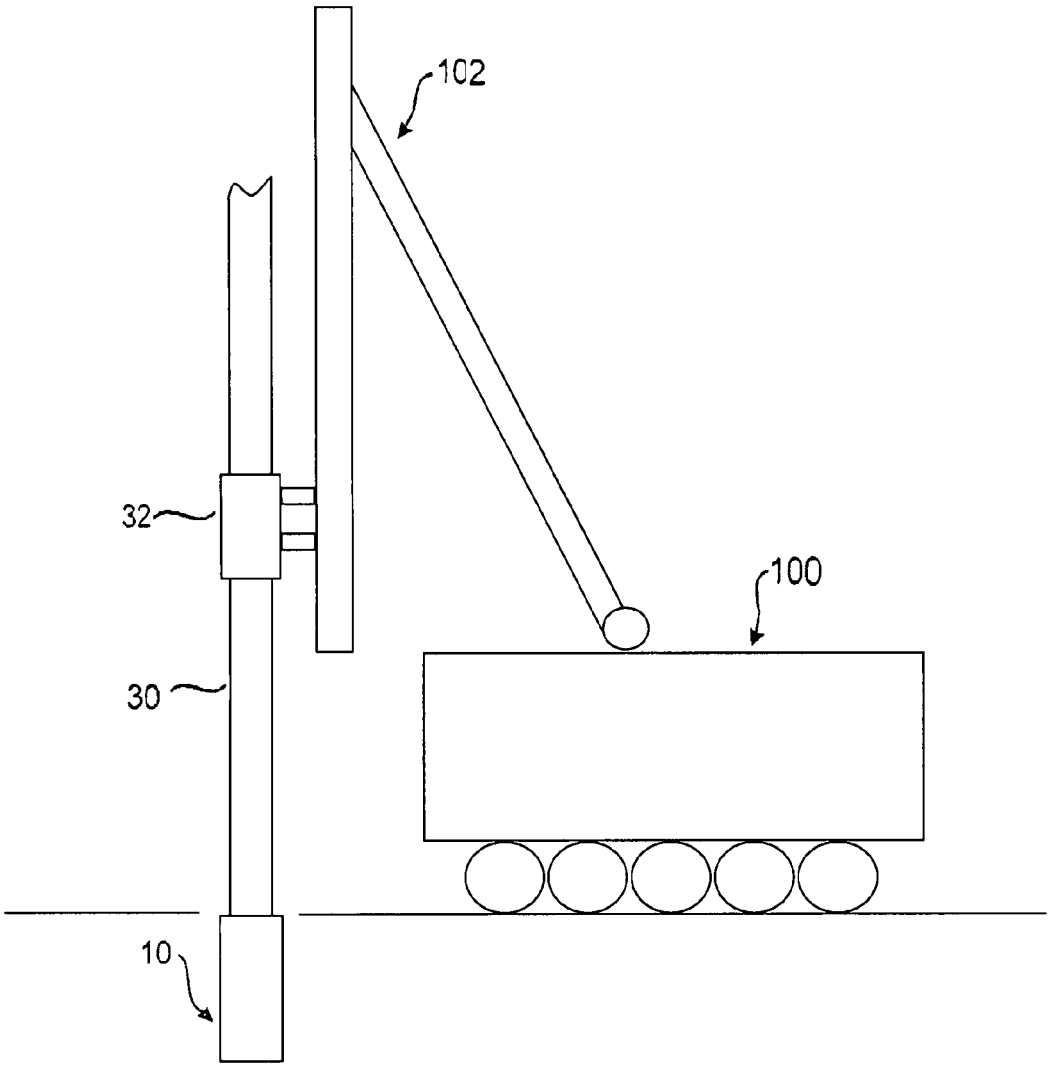
FIG. 3 is a diagrammatic side view of a construction truck having the trench wall cutter of FIGS. 1 and 2 located thereon.

FIGS. 1 and 2 show different method stages I to V in the production of an inventive trench wall using an inventive method. The drawings are side views of a trench wall apparatus along the trench wall recesses produced. The trench wall apparatus used for producing the trench wall is constructed as a trench wall cutter 10. Said trench wall cutter 10 has a frame 13 on the bottom of which are mounted so as to be drivable in rotary manner two cutting wheels 20, 20'. For working off soil material on the circumferential side of the cutting wheels 20, 20' are provided cutting tooth holders 23 with cutting teeth 24. The cutting wheels 20, 20' are constructed as wheel pairs with in each case two coaxial individual cutting wheels succeeding one another in the drawing plane.

For sinking and raising the trench wall cutter 10, the latter on its frame 13 is located at the lower end of a cutting linkage 30. In the present embodiment the cutting linkage 30 is in the form of a rigid shaft, which is axially displaceably guided in a diagrammatically represented guide sleeve 32 (cf. FIG. 1 step III) outside the trench. This forms a rigid linear guide device which only allows a movement of the cutting linkage 30 with the trench wall cutter 10 in the axial direction of said linkage and consequently axially guides the cutter 10. In the present embodiment the axial direction coincides with the vertical, so that a horizontal displacement is meant by a lateral displacement. However, the trench wall apparatus can also be guided so as to slope relative to the vertical by means of the linear guide device. In order to achieve particularly significant cutting depths, the cutting linkage 30 can also have a telescopable construction.

For a particularly simple lateral pivoting in the area below the obstacle, the trench wall cutter 10, particularly for forming the lower trench wall recess 60, is displaced with the linear guide device (the linkage 30 guided in the guide sleeve 32) along the trench wall to be produced by means of a displacement mechanism. According to this embodiment the linear guide device is displaced laterally for pivoting in the trench wall apparatus, the lateral movement being transferred by the rigid linear guide device to the trench wall cutter 10. Thus, in this case the pivoting in of the trench wall apparatus is brought about by a displacement of the linear guide device and the corresponding displacement device can preferably be located outside the trench wall recess and/or can have a construction truck 100. In particular, no pivoting in devices have to be provided on the trench wall apparatus, so that the latter can have a particularly simple construction.

In order to be able to produce tight trench walls in the ground even when there are large obstacles, according to the invention for forming the lower trench wall recess 60 the trench wall cutter 10 can be introduced under the obstacle 1 at an oblique angle. For introduction under an oblique angle it is in particular possible to tilt the linear guide device 32 and for this purpose e.g. on the construction truck 100 where the linear guide device 32 is located a pivoting device 102 can be provided. Alternatively or additionally the trench wall cutter 10 can also be simultaneously axially and laterally moved, i.e. can be pivoted in laterally accompanied by simultaneous lowering and/or raising.

Throughout the cross-section of frame 13 of trench wall cutter 10 is smaller than the cutting cross-section of the two cutting wheels 20, 20'. Starting from the cutting wheels 20, 20' being located at the bottom, the frame 13 tapers to the cutting linkage 30 being located at the top in a space direction roughly perpendicular to the rotation axes of the cutting' wheels 20, 20'. Such a taper can fundamentally also exist in other space directions.

Between the two cutting wheels 20, 20' is provided a liquid supply device 40 by means of which a liquid binder can be introduced into the trench for in situ suspension production. The soil material worked off by the cutting wheels 20, 20' can also be sucked out of the trench and the latter can be filled with a settable suspension or non-setting support suspension produced outside the trench.

By means of the inventive method illustrated in the drawings in an area of the ground 3 where in the present case there is a pipe which constitutes the obstacle 1, a trench wall is produced and through it projects said obstacle 1. In a first method step I of the inventive method the two cutting wheels 20, 20' are rotated by a drive located in frame 13 and the trench wall cutter 10 sinks a first lateral trench wall recess 51 located to the left in the drawing. The first lateral trench wall recess 51 is directed vertically and therefore moves past the obstacle 1 in such a way that the latter is not cut.

On reaching the intended final depth for the lateral trench wall recess 51, in the step II the trench wall cutter 10 with the cutting wheels 20, 20' still rotating is pivoted laterally into the soil area below the obstacle 1 as a result of the lateral displacement of the linear guide device, particularly by the movement of the guide sleeve 32 on the surface of the earth. Through the action of the cutting wheel 20' the soil material to the right of the trench wall cutter 10 in the drawing is worked off in a first partial area 71 below the obstacle 1. For increasing the first partial area 71 the pivoted in trench wall cutter 10, optionally accompanied by further pivoting in and optionally several times, can be moved axially up and/or down in the ground 3. After producing the first partial area 71 the trench wall cutter 10 is again pivoted back into the first lateral trench wall recess 51 and is drawn out of the ground 3.

By lateral movement of the linear guide device the trench wall cutter 10 is then laterally displaced out of the ground 3 and in the method step III and accompanied by the formation of a further, second lateral trench wall recess 52, which runs vertically and laterally along the obstacle 1, is sunk. The second lateral trench wall recess 52 also runs directly past the obstacle 1, but in the drawing is to the right of obstacle 1.

In the following method step IV, the trench wall cutter 10 is pivoted into the left through the movement of the linear guide device. As in method step II, the trench wall cutter 10 is raised and/or lowered, optionally several times. As a result soil material is released in a second partial area 72 below the obstacle 1. The second partial area 72 is enlarged until there is an opening in the first partial area 71 adjacent thereto. In this way a lower trench wall recess 60 is formed below the obstacle 1 and links the two lateral trench wall recesses 51, 52 below said obstacle 1. For a particularly high tightness of the trench wall, it is advantageous for the trench wall cutter 10 to be moved further in the lateral direction even after the opening has been made and consequently the two partial areas 71, 72 overlap.

Following on to the method step IV, the trench wall cutter 10 is raised again, moved laterally and positioned above the obstacle 1. In method step V the trench wall cutter 10 is vertically sunk, accompanied by the formation of an upper trench wall recess 56, until the cutting wheels 20, 20' just fail to cut the obstacle. This step is obviated if the obstacle 1 extends to the ground surface. For forming the upper trench wall recess 56 the trench wall cutter 30 can also be sunk several times, accompanied by lateral displacement.

As can be seen in FIG. 2, as a result of the tapering construction of the frame 13, it is possible to cut the two partial areas 71, 72 and therefore the lower trench wall recess 60 into the immediate vicinity of obstacle 1. The more pronounced the taper, the further the trench wall cutter 10 can be moved laterally under the obstacle 1. However, any soil material remaining below the obstacle 1 can be removed and/or sealed in a further operating step.

As shown in FIG. 1, the cutting cross-section of the trench wall cutter 10 and the lateral displacement thereof during the production of the trench wall recesses 51, 56, 52 are selected in such a way that on sinking the trench wall recesses, 51, 56, 52 in each case adjacent recesses 51, 56, 52 are cut, i.e. working takes place with superimposed cutting cross-section. Thus, a laterally closed and therefore a particularly tight trench wall can also be obtained above the obstacle 1.

In order to be able to produce particularly rapidly the lower trench wall recess 60, it can be advantageous, following the completion of the lateral trench wall recess 51 and/or 52, to raise the trench wall cutter 10 to the height of the obstacle 1 and then guide it downwards with its frame 13 along the obstacle 1, i.e. to move the trench wall cutter 10 simultaneously laterally and axially following the outer contour of obstacle 1. As soon as the partial area 71 and/or 72 formed reaches the desired width, the trench wall cutter 10 can be lowered axially further to the desired final depth.

In the embodiments shown, by means of the liquid supply device 40 a hardenable liquid is supplied during the lowering and/or raising of the trench wall cutter 10 and the soil material loosened during the production of the trench wall recesses 51, 52, 56, 60 is mixed directly in the trench wall recesses 51, 52, 56, 60 through the action of the cutting wheels 20, 20' with said liquid to a hardening suspension, which constitutes the finished trench wall after hardening.

Method steps I to V illustrated in the drawings can fundamentally be performed in a random order. Thus, it is e.g. also possible initially to produce the two lateral trench wall recesses 51, 52 and the upper trench recess 56 and only then cut off the two partial areas 71, 72 for forming the lower trench wall recess 60. More particularly if the soil material worked off by the cutting wheels 20, 20' is to be conveyed out of the trench, it is advantageous to sink the upper trench wall recess 56 prior to producing the two partial areas 71, 72, because otherwise soil material loosened during the production of the upper trench wall recess 56 could reach the bottom of the partial areas 71, 72 and would have to be pumped away from there in a costly manner.

The invention claimed is:

1. A method for producing a trench wall in the ground through which an obstacle projects, using a soil-removing trench wall cutter having a frame and at least two cutting wheels mounted on the bottom of the frame for rotary motion about parallel axes of rotation, comprising the steps of:

sinking lateral trench wall recesses on either side of the obstacle by sinking the trench wall cutter into the ground past the obstacle in a direction having a vertical component, while rotating the at least two cutting wheels about the parallel axes of rotation;

producing a lower trench wall recess below the obstacle by laterally pivoting in the trench wall cutter from at least one of the two lateral trench wall recesses into the ground below the obstacle while rotating the at least two cutting wheels about the parallel axes of rotation, whereby the lower trench wall recess and at least one of the lateral trench wall recesses are produced with the same trench wall cutter.

2. The method according to claim 1, wherein in the producing step, the trench wall cutter is moved in from both lateral trench wall recesses below the obstacle.

3. The method according to claim 1, wherein the trench wall cutter is located on a rigid linear guide device.

4. The method according to claim 3, wherein in the producing step, the trench wall cutter is moved together with the linear guide device along the trench wall to be produced by means of a displacement device.

5. The method according to claim 1, wherein in the producing step, the trench wall cutter is introduced under the obstacle with an oblique angle.

6. The method according to claim 1, further comprising the step of producing an upper trench wall recess above the obstacle.

7. The method according to claim 1, wherein in the sinking step, at least one of the trench wall recesses is produced at a distance from the obstacle.

8. The method according to claim 1, further comprising the step of mixing soil material loosened during the sinking of the trench wall recesses with a binder within the trench wall recesses to form a settable suspension.

9. The method according to claim 6, wherein the sinking step is performed before the producing step.

10. The method according to claim 1, wherein in the sinking and producing steps, at least one of the two cutting wheels is used both for making the lateral trench wall recesses and for making the lower trench wall recesses.

* * * * *